US007862483B2

(12) United States Patent
Hendrickson et al.

(10) Patent No.: US 7,862,483 B2
(45) Date of Patent: Jan. 4, 2011

(54) INCLINING TREADMILL WITH MAGNETIC BRAKING SYSTEM

(75) Inventors: Rick W. Hendrickson, River Heights, UT (US); Greg W. Law, Smithfield, UT (US); Rodney L. Hammer, Lewiston, UT (US); Paul C. Ricks, Petersboro, UT (US); Darren C. Ashby, Richmond, UT (US)

(73) Assignee: ICON IP, Inc., Logan, UT (US)

( * ) Notice: Subject to any disclaimer, the term of this patent is extended or adjusted under 35 U.S.C. 154(b) by 94 days.

(21) Appl. No.: 12/340,407

(22) Filed: Dec. 19, 2008

(65) Prior Publication Data

US 2009/0137367 A1 May 28, 2009

Related U.S. Application Data

(63) Continuation-in-part of application No. 10/788,799, filed on Feb. 27, 2004, now Pat. No. 7,537,549, and a continuation-in-part of application No. 09/496,569, filed on Feb. 2, 2000, now Pat. No. 6,761,667.

(60) Provisional application No. 60/542,437, filed on Feb. 6, 2004.

(51) Int. Cl.
*A63B 22/02* (2006.01)

(52) U.S. Cl. ..... 482/54; 482/52

(58) Field of Classification Search ..... 482/4, 482/5, 6, 51, 52, 54, 110, 903, 1, 7, 8, 9, 482/901, 902; 318/432, 433, 434, 802
See application file for complete search history.

(56) References Cited

U.S. PATENT DOCUMENTS

| | | | | |
|---|---|---|---|---|
| 3,592,466 | A | 7/1971 | Parsons | |
| 3,602,502 | A | 8/1971 | Hampl | |
| 3,869,121 | A * | 3/1975 | Flavell | 482/2 |
| 3,903,613 | A | 9/1975 | Bisberg | |
| 4,151,988 | A | 5/1979 | Nabinger | |
| 4,358,105 | A | 11/1982 | Sweeney, Jr. | |
| 4,408,613 | A | 10/1983 | Relyea | |
| 4,544,152 | A | 10/1985 | Taitel | |
| 4,659,074 | A | 4/1987 | Taitel et al. | |

(Continued)

OTHER PUBLICATIONS

Office Action dated Apr. 2, 2007, 7 pages, U.S. Appl. No. 10/788,799.

(Continued)

*Primary Examiner*—Loan Thanh
*Assistant Examiner*—Tam Nguyen
(74) *Attorney, Agent, or Firm*—Workman Nydegger

(57) ABSTRACT

A selectively inclining hiking exercise apparatus supports a user ambulating thereon. The selectively inclining hiking exercise apparatus includes a support base and a treadbase that selectively inclines with respect to the support base. The treadbase includes a motor for driving an endless belt upon which the user ambulates. The treadbase also includes a magnetic braking assembly for regulating the speed of the endless belt to prevent the endless belt from moving at a rate that is faster than the rate at which the treadbase motor is driving the endless belt. The magnetic braking assembly includes a magnet that selectively moves relative to the treadbase flywheel along a threaded lead screw to provide the braking force.

33 Claims, 10 Drawing Sheets

U.S. PATENT DOCUMENTS 4,659,078 A 4/1987 Blome
4,687,195 A 8/1987 Potts
4,708,337 A 11/1987 Shyu
4,759,540 A 7/1988 Yu et al.
4,786,049 A 11/1988 Lautenschlager
4,790,528 A 12/1988 Nakao et al.
4,828,257 A 5/1989 Dyer et al.
4,842,266 A 6/1989 Sweeney, Sr. et al.
4,848,737 A 7/1989 Ehrenfield
4,869,497 A 9/1989 Stewart et al.
4,913,396 A 4/1990 Dalebout et al.
4,927,136 A 5/1990 Leask
4,934,692 A * 6/1990 Owens ..... 482/63
4,941,652 A * 7/1990 Nagano et al. ..... 482/73
4,998,725 A 3/1991 Watterson et al.
5,029,801 A 7/1991 Dalebout et al.
5,062,632 A * 11/1991 Dalebout et al. ..... 482/7
5,067,710 A 11/1991 Watterson et al.
5,085,426 A 2/1992 Wazner et al.
5,088,729 A 2/1992 Dalebout
5,094,447 A 3/1992 Wang
5,145,475 A 9/1992 Cares
5,163,885 A 11/1992 Wazner et al.
5,195,935 A 3/1993 Fencel
5,203,826 A 4/1993 Dalebout ..... 74/572
5,247,853 A 9/1993 Dalebout ..... 74/572
5,292,293 A 3/1994 Schumacher
5,310,392 A 5/1994 Lo
D348,493 S 7/1994 Ashby
5,328,420 A 7/1994 Allen
5,328,422 A 7/1994 Nichols
5,352,166 A 10/1994 Chang
5,352,167 A 10/1994 Ulicny
5,372,559 A 12/1994 Dalebout et al.
5,382,208 A 1/1995 Hu
5,382,209 A 1/1995 Pasier et al.
5,431,612 A 7/1995 Holden
5,466,203 A 11/1995 Chen
5,489,250 A 2/1996 Densmore et al.
5,512,025 A 4/1996 Dalebout et al.
5,518,471 A 5/1996 Hettinger et al.
5,527,245 A 6/1996 Dalebout et al.
5,545,112 A * 8/1996 Densmore et al. ..... 482/54
5,626,539 A 5/1997 Piaget et al.
5,643,153 A * 7/1997 Nylen et al. ..... 482/110
5,650,709 A * 7/1997 Rotunda et al. ..... 318/802
5,674,453 A 10/1997 Watterson et al.
5,683,332 A 11/1997 Watterson et al.
5,718,657 A 2/1998 Dalebout et al.
5,733,228 A 3/1998 Stevens
5,738,612 A 4/1998 Tsuda
5,743,833 A 4/1998 Watterson et al.
5,752,897 A * 5/1998 Skowronski et al. ..... 482/54
5,810,696 A 9/1998 Webb
5,827,155 A 10/1998 Jensen et al.
5,833,577 A 11/1998 Hurt
5,860,893 A 1/1999 Watterson et al.
5,860,894 A 1/1999 Dalebout et al.
5,879,273 A * 3/1999 Wei et al. ..... 482/63
5,890,995 A 4/1999 Bobick et al.
5,899,834 A 5/1999 Dalebout et al.
5,916,069 A * 6/1999 Wang et al. ..... 482/72
5,947,872 A 9/1999 Ryan et al.
6,013,011 A 1/2000 Moore et al.
6,027,429 A 2/2000 Daniels
D421,779 S 3/2000 Piaget et al.
6,033,347 A 3/2000 Dalebout et al.
6,045,490 A 4/2000 Shafer et al.
6,050,921 A 4/2000 Wang
6,050,923 A 4/2000 Yu
6,053,844 A 4/2000 Clem
6,059,692 A 5/2000 Hickman
6,068,578 A 5/2000 Wang
6,110,076 A 8/2000 Hurt
6,132,340 A 10/2000 Wang et al.
6,152,856 A 11/2000 Studor et al.
6,174,268 B1 1/2001 Novak
6,179,753 B1 1/2001 Barker et al.
6,231,482 B1 5/2001 Thompson
6,234,936 B1 5/2001 Wang
6,261,209 B1 7/2001 Coody
6,273,843 B1 8/2001 Lo
6,280,362 B1 8/2001 Dalebout et al.
D447,780 S 9/2001 Arnold et al.
6,293,375 B1 * 9/2001 Chen ..... 188/164
D450,792 S 11/2001 Kuo
6,312,363 B1 * 11/2001 Watterson et al. ..... 482/54
6,416,444 B1 * 7/2002 Lim et al. ..... 482/54
6,432,026 B1 8/2002 Wang et al.
6,447,424 B1 9/2002 Ashby et al.
6,461,275 B1 10/2002 Wang et al.
6,475,121 B2 11/2002 Wang et al.
6,533,707 B2 3/2003 Wang et al.
6,699,159 B2 3/2004 Rouse
6,761,667 B1 7/2004 Cutler et al.
6,913,563 B2 7/2005 Chen
6,974,404 B1 12/2005 Watterson et al.
7,052,440 B2 5/2006 Pyles et al.
7,285,075 B2 10/2007 Cutler et al.
7,537,549 B2 5/2009 Nelson
2010/0222182 A1 * 9/2010 Park ..... 482/54

OTHER PUBLICATIONS

Office Action dated Jan. 25, 2008, 10 pages, U.S. Appl. No. 10/788,799.
Notice of Allowance and Fees Due dated Dec. 23, 2008, 8 pages, U.S. Appl. No. 10/788,799.
Office Action dated Aug. 21, 2002 from U.S. Appl. No. 09/496,569 (3 pages).
Office Action dated Jun. 3, 2003 from U.S. Appl. No. 09/496,569 (3 pages).
Notice of Allowance dated Mar. 5, 2004 from U.S. Appl. No. 09/496,569 (6 pages).
Issue Notification from U.S. Appl. No. 09/496,569 (1 page).
Reebok User's Manual—ACD1 Treadmill, Copyright 1998 (26 pages).
Reebok User's Manual—ACD2 Treadmill, Copyright 1998 (28 pages).
Reebok User's Manual—ACD3 Treadmill, Copyright 1999 (32 pages).
Treadclimber by Nautilus, Copyright 2003 (1 page).
Reebok Store Reebok RX 7200 Treadmill w/10 workout options, http://store.reebok.com/product/index.jsp, Nov. 3, 2003 (14 pages).
NordicTrack 9800 Incline Trainer User's Manual, Copyright 2004 (43 pages).
International Search Report for PCT/DE02/02213, relating to WO03101543A1, disclosed in "Foreign Patent Documents," dated Nov. 18, 2002 (6 pages).
Damark International, Inc. Mail Order Catalog, dated Nov. 17, 1994, cover page and p. 6.
Treadmill Owner's Manual by Formula 22100 Manual Treadmill, upon information and belief, available at least as early as 1998, 20 pages.
Sears, Roebuck and Co., *Pro-Form 585 TL Low Profile Treadmill, User's Manual*, Copyright 1996, 20 pages.
Supplemental Notice of Allowability dated Feb. 20, 2009, 5 pages, U.S. Appl. No. 10/788,799.
Supplemental Notice of Allowability dated Apr. 16, 2009, 5 pages, U.S. Appl. No. 10/788,799.

* cited by examiner

INCLINING TREADMILL WITH MAGNETIC BRAKING SYSTEM

CROSS-REFERENCE TO RELATED APPLICATIONS

This application is a continuation-in-part of U.S. patent application Ser. No. 10/788,799, filed Feb. 27, 2004, entitled "Incline Assembly with Cam", which is incorporated herein by reference in its entirety, and which i) claims priority to and the benefit of U.S. Provisional Patent Application No. 60/542,437, filed Feb. 6, 2004, entitled "Incline Motor with Cam Assembly", which is incorporated herein by reference in its entirety, and ii) is a continuation-in-part of U.S. patent application Ser. No. 09/496,569, filed Feb. 2, 2000, entitled "Hiking Exercise Apparatus", now U.S. Pat. No. 6,761,667, which is incorporated herein by reference in its entirety.

BACKGROUND

1. Technical Field

This invention is in the field of exercise equipment. More specifically, this invention is in the field of climbing exercise apparatuses.

2. The Relevant Technology

The desire to improve health and enhance cardiovascular efficiency has increased in recent years. This desire has been coupled with the desire to exercise in locations which are compatible with working out within a limited space such as within an individual's home or exercise gym. This trend has led to an increased desire for the production of exercise equipment.

Climbing apparatuses have become very popular in recent years. Climbing requires a user to raise the user's knees in continual, strenuous strides. Climbing typically requires more exertion than mere walking on a flat surface. Consequently, the exercise of climbing can provide a more intense, challenging workout.

Climbing exercise apparatuses typically feature an endless moving assembly which is set on a significant angle and has a series of circulating foot supports, steps, or paddles. This configuration requires the exerciser to engage in continual climbing motions and allows the exerciser to simulate the movements of climbing up a steep incline. Angled, moving staircase-type devices are typical examples of such climbing apparatuses.

However, typical climbing apparatuses within the art are tall and often require more ceiling height than is available in an exerciser's home. This phenomenon is typically due at least in part to large moving steps or paddles which require a necessary amount of clearance above a floor. The steep angle of the climbing apparatuses also contributes to the height of the machines. Thus, such climbing apparatuses often require a high-ceiling gym, a warehouse, or a vaulted ceiling for use. Typical climbing apparatuses also comprise a variety of different, complicated moving parts.

Treadmill apparatuses also offer a popular form of exercise, e.g., running and walking. A variety of different styles of treadmills have been produced. Certain treadmill apparatuses which fit into a user's home incline from a neutral position to an inclined position, then decline back to the neutral position. However, typical treadmills fail to adequately provide a user with the kind of terrain experience encountered when climbing mountainous, rocky, and rough terrain. Furthermore, hiking typically requires a great deal of lateral movement i.e. side-to-side movement to stabilize footings and leg movements. Typical treadmills, however, are designed for length rather than width. In other words, typical treadmills are long and thin.

What is therefore needed is an exercise apparatus which simulates the dynamic of natural terrain with its accompanying slopes and inclines and can fit into a user's home or another location with a limited ceiling height. What is also needed is an exercise apparatus which is convenient to manufacture, assemble and service.

BRIEF SUMMARY

A hiking-type exercise apparatus according to some aspects of the present invention comprises a selectively inclining and selectively declining treadbase. The treadbase is pivotally coupled to a support base configured to be mounted on a support surface. In a neutral position, the treadbase is substantially parallel to the support surface. In one embodiment, the distal end of the treadbase selectively inclines above the neutral position and selectively declines below the neutral position.

The treadbase is capable of inclining to extreme angles, such that the distal end of the treadbase is high above the neutral position. This extreme inclining enables an exerciser to selectively simulate a hiking motion similar to a typical hike across a mountainous peak. Optionally, it is possible to walk or run with the treadbase in a flat, neutral position, which can also be found on occasion during hikes in the mountains. Thus, the hiking apparatus of the present invention is designed to closely simulate typical mountainous terrain.

The pivotal coupling of the treadbase to the support base may occur in a variety of different locations depending upon the particular embodiment of the present invention. In one embodiment, the treadbase is pivotally coupled remotely from an end thereof to the support base. This remote coupling improves the leverage of the system and conserves space and motor output, improving the ability to incline or decline the treadbase to extreme angles in a limited space, such as within a user's home. The remote coupling also enables the treadbase to incline or decline without vertically raising the ambulating surface of the moving belt significantly with respect to a handrail assembly supporting the user's hands. The hiking apparatus also achieves hiking-type angles with relatively simple parts.

One feature of the hiking apparatus of the present invention is that it allows significant lateral movement capability of feet, thereby more accurately simulating the movements performed during hiking. This lateral movement can be improved by employing an improved belt aspect ratio, i.e., the length and width of treadbase is such that the hiking apparatus simulates a hiking motion and allows significant lateral movement. In one embodiment, the width of the endless belt is at least ½ the size of the length of the belt (the length of the belt being measured from the center of the proximal treadbase roller to the center of the distal treadbase roller).

As another advantage, the hiking apparatus includes a magnetic braking assembly for regulating the speed of an endless belt upon which a user ambulates. When the treadbase is significantly inclined, the user's weight can cause the endless belt to rotate at a faster rate than the rate at which the treadbase motor is driving the belt. This can cause the user to move down the treadbase toward the floor surface. The magnetic braking assembly can prevent the endless belt from rotating at a faster rate than that set by the treadbase motor.

In one embodiment, the magnetic braking assembly includes a magnet that is selectively moveable along a threaded lead screw. Upon movement of the lead screw, as caused by a lead screw motor, the magnet selectively moves either closer to or further away from the treadmill flywheel. The magnetic force between the magnet and the flywheel increases as the magnet moves closer to the flywheel. The increased magnetic force causes the flywheel to rotate more slowly, thereby slowing the rotation of the endless belt. The slowing of the endless belt by the braking system can thereby prevent a user from moving toward the floor surface when the treadbase is inclined. The braking assembly can also include circuitry that detects when braking is needed and controls the movement of the magnet along the lead screw.

The braking system is particularly useful with a high incline treadmill apparatus, such as a hiking apparatus. The braking system's reliance on the magnetic force between the magnetic member and the flywheel reduces the amount of contact between moving parts when compared to a friction-type braking system. Reducing the amount of contact between the braking system components leads to less wear on the components.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
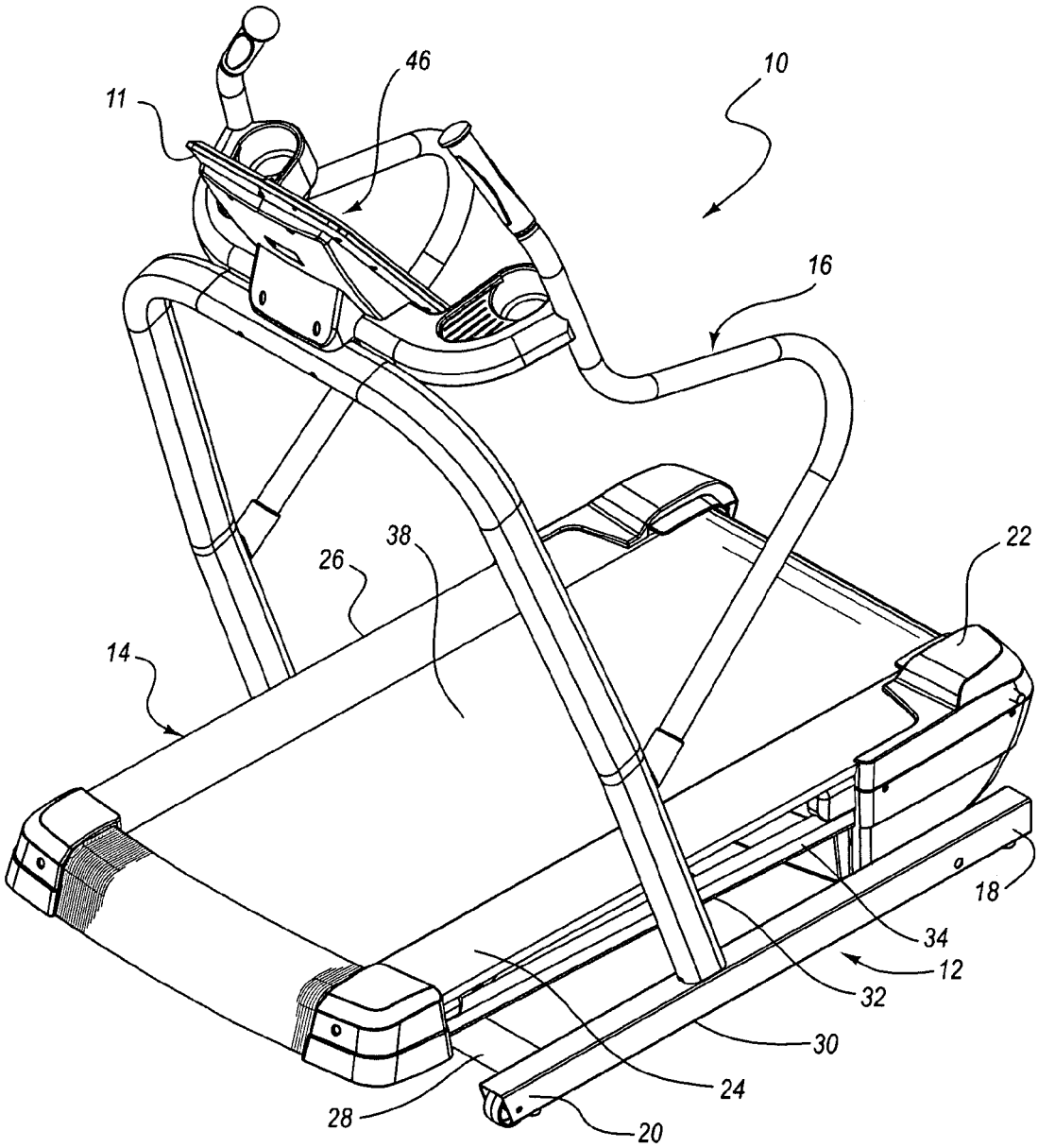
FIG. 1 illustrates a perspective view of a hiking exercise apparatus according to the present invention.

With reference now to FIGS. 1-6B, a selectively inclining and selectively declining exercise apparatus 10 of the present invention is shown. Exercise apparatus 10 can support a user ambulating thereon in a hiking, running, or walking mode. Thus, while exercise apparatus 10 is sometimes referred to herein as a hiking or hiker-type exercise apparatus, exercise apparatus 10 can also be a treadmill. Furthermore, exercise apparatus 10 can be configured such that a user can use exercise apparatus 10 as a treadmill and as a hiker.

Selectively inclining and declining apparatus 10 comprises a support base 12, a treadbase 14, and a handrail assembly 16. Support base 12 has a proximal end 18 and a distal end 20. Treadbase 14 has a proximal end 22, a distal end 24, and an inner portion 26 therebetween. Treadbase 14 is pivotally coupled to support base 12. The length and width of treadbase 14 is such that hiking apparatus 10 simulates a hiking motion, yet has a minimal footprint and can be conveniently used and stored in a home or exercise gym.

Figure 2:
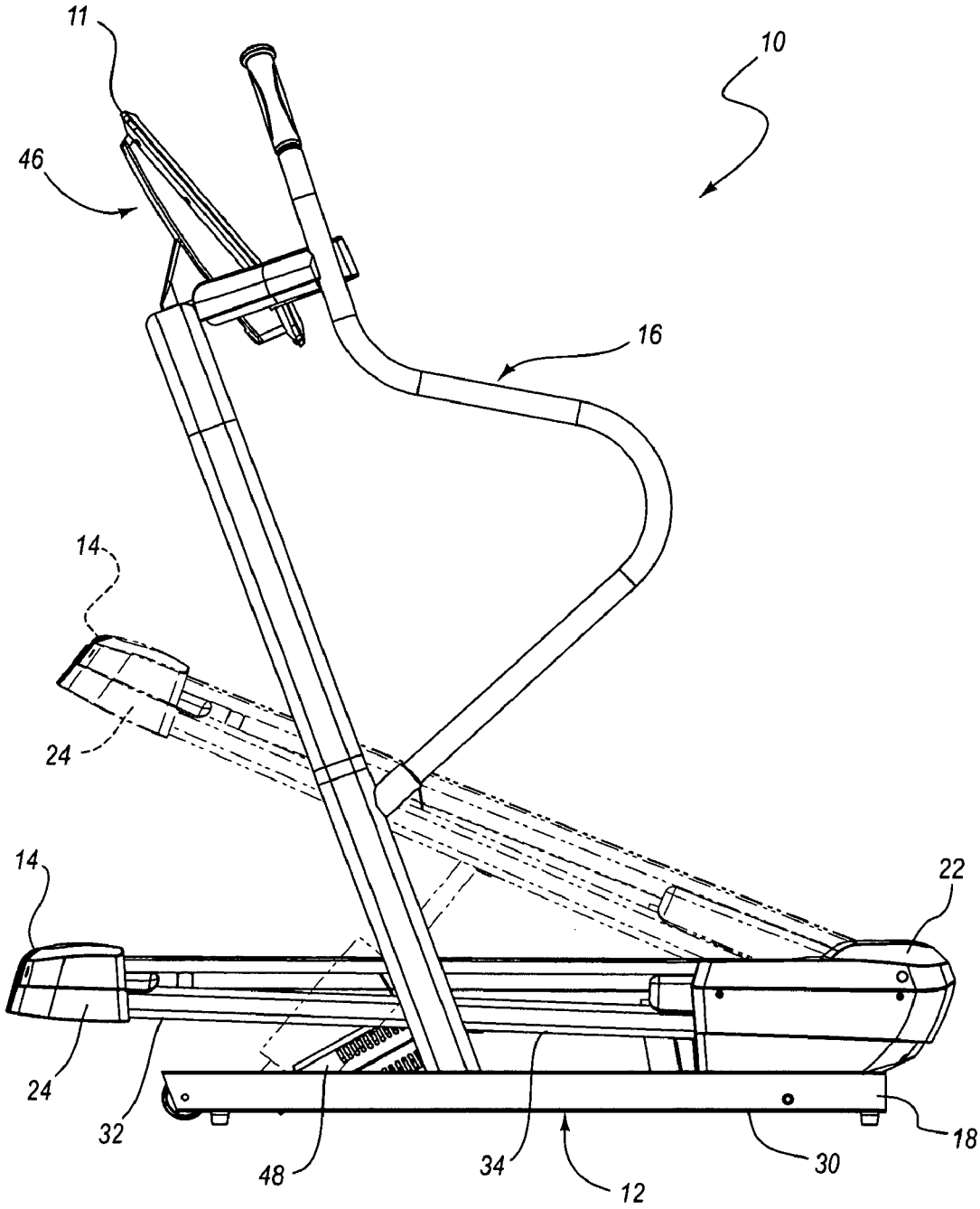
FIG. 2 illustrates a side view of the apparatus of FIG. 1 with the treadbase shown in a neutral position, and a raised position featured in phantom view.
Figure 3:
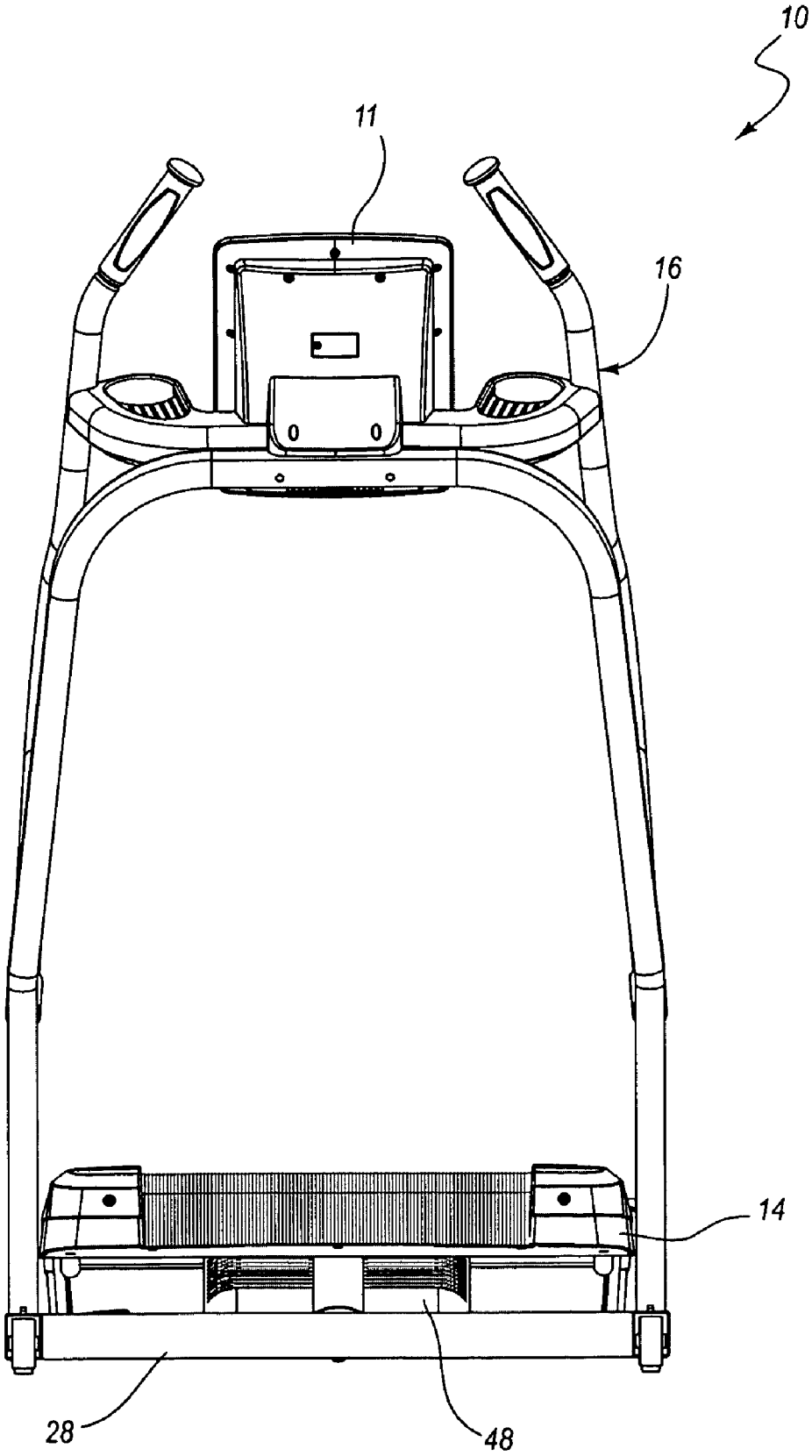
FIG. 3 illustrates a front end view of the apparatus of FIG. 1.
Figure 4:
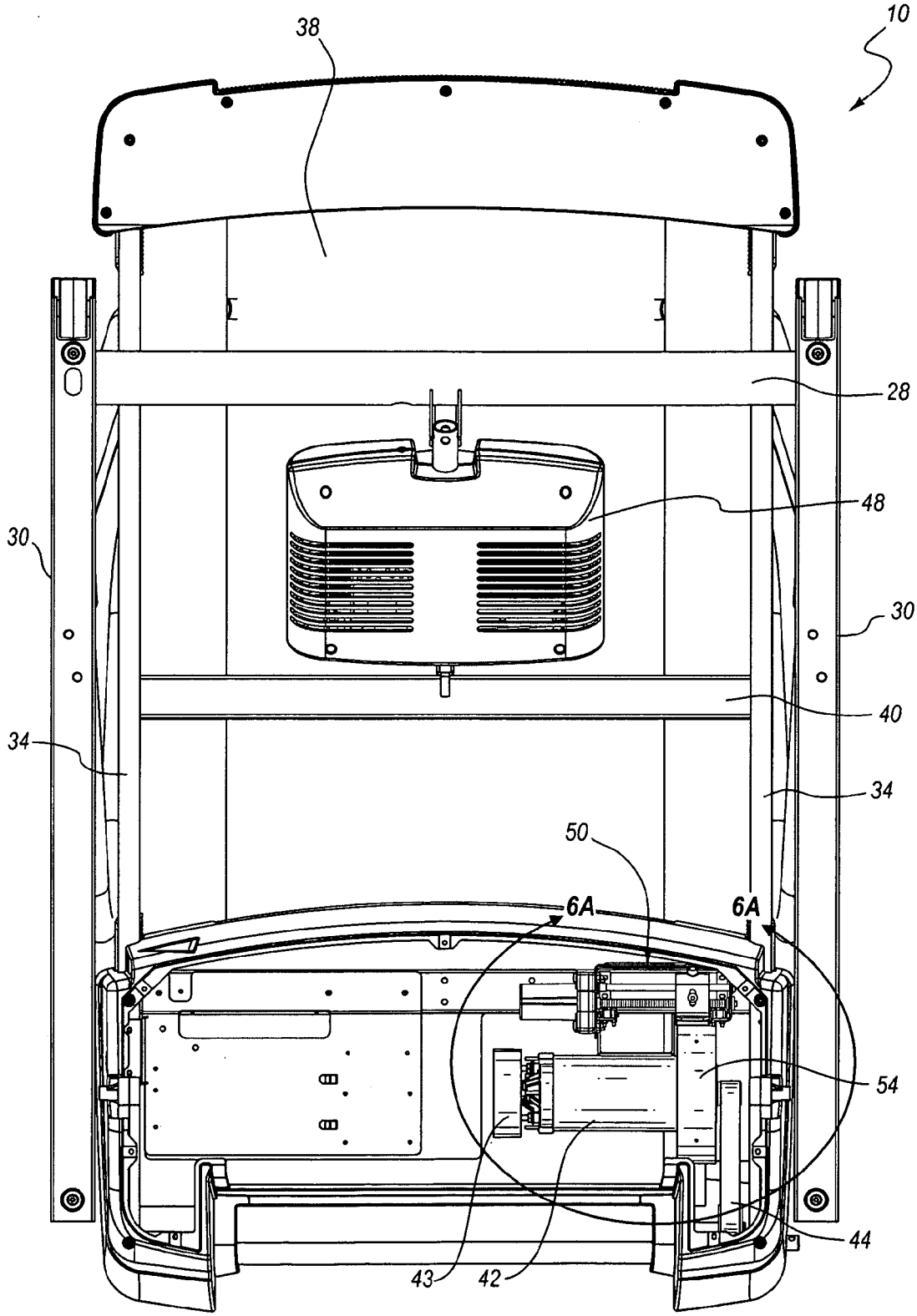
FIG. 4 illustrates a bottom view of the apparatus of FIG. 1 showing the belt motor and braking system.

As depicted in phantom lines in FIG. 2, in an inclined position, treadbase 14 is capable of inclining to extreme angles, such that distal end 24 is high above the neutral position. This enables an exerciser to simulate a hiking motion which requires the user to continually lift the user's knees in an upward, outstretched manner. In the neutral position shown in solid line in FIG. 2, treadbase 14 is substantially parallel to a support surface.

In one embodiment, treadbase 14 can also be configured to decline into a declined position in which distal end 24 drops below the neutral position. Typical hikes in the mountains, for example, involve inclines and declines as well as flat surfaces, each of which can be accommodated by treadbase 14. Thus, apparatus 10 is able to more closely simulate typical mountainous terrain.

The coupling of treadbase 14 to support base 12 may occur in a variety of different positions depending upon the embodiment. Examples of different coupling positions and embodiments are disclosed in U.S. Pat. No. 6,761,667, entitled "Hiking Exercise Apparatus", which is incorporated herein by reference in its entirety. In the illustrated embodiment, treadbase 14 is pivotally coupled at proximal end 22 to proximal end 18 of support base 12.

A variety of different embodiments of support bases may also be employed in the present invention. The support base rests on a support surface. The treadbase is mounted thereon. Support base 12 of FIGS. 1-5A is comprised of first and second opposing side members 30 and a cross member 28 extending therebetween. In the illustrated embodiment, cross member 28 is positioned near distal end 20 of support base 12.

Treadbase 14 may also be comprised of a variety of different members. In the illustrated embodiment, treadbase 14 comprises a treadbase frame 32 having first and second longitudinally extending side rails 34. First and second rollers (not shown) extend between proximal and distal ends of first and second side rails 34, respectively. An endless belt 38 is movably mounted on the first and second rollers. Treadbase frame 32 also includes inner portion cross member 40 extending between the center portions of first and second side rails 34. Treadbase 14 further comprises a motor 42 coupled to treadbase frame 32. Treadbase 14 also comprises a drive belt 44 mounted on (i) a flywheel pulley coupled to motor 42; and (ii) a roller pulley coupled to the first roller. Actuation of motor 42 rolls the first roller, thereby turning endless belt 38.

Motor 42 can have a fan 43 coupled thereto for cooling motor 42 and other components near fan 43. In addition to the heat generated by motor 42, a braking system 50, which will be described in greater detail below, can generate heat near motor 42. Fan 43 can be adapted to provide cooling to motor 42 and/or braking system 50. In the embodiment illustrated in FIGS. 4-6B, fan 43 is coupled to an end of motor 42 and includes multiple blades 45 for moving air as fan 43 rotates. Blades 45 can be generally flat, angled blades, or blades 45 can be cup-shaped. Fan 43 can be adapted to move air toward or away from motor 42 and/or braking system 50.

Fan 43 can be adapted to run continuously or on an as needed basis. For example, fan 43 can be adapted to run continuously when motor 42 is operating. In such an embodiment, fan 43 can be coupled to a rotating shaft of motor 42. Thus, whenever the shaft of motor 42 is activated to rotate belt 38, fan 43 will also rotate, thereby providing cooling to motor 42. Alternatively, fan 43 can be adapted to run only when motor 42 exceeds a predetermined temperature. In other embodiments, fan 43 can be adapted to run for a predetermined amount of time. Thus, fan 43 can be configured to provide any needed cooling for motor 42 and/or other components, such as braking system 50.

In addition to fan 43, flywheel 54 can also provide cooling to motor 42 and/or braking system 50. For example, similar to fan 43, flywheel 54 can include multiple blades 55 and/or apertures 57 therethrough. Blades 55 can be generally flat, angled blades, or blades 55 can be cup-shaped. Blades 55 can be adapted to move air toward or away from motor 42 to cool motor 42. Additionally, apertures 57 can be adapted to facilitate the dissipation of heat away from motor 42, such as by allowing hot air near motor 42 to flow through apertures 57 and away from motor 42. Furthermore, when braking system 50 is employed, heat can be generated near the rim or periphery of flywheel 54. The heat can be transferred by conduction through flywheel 54 to motor 42. The inclusion of apertures 57 reduces the amount of material in flywheel 54 through which heat can conducted, thereby reducing the amount of heat transferred from flywheel 54 to motor 42.

Figure 5A:
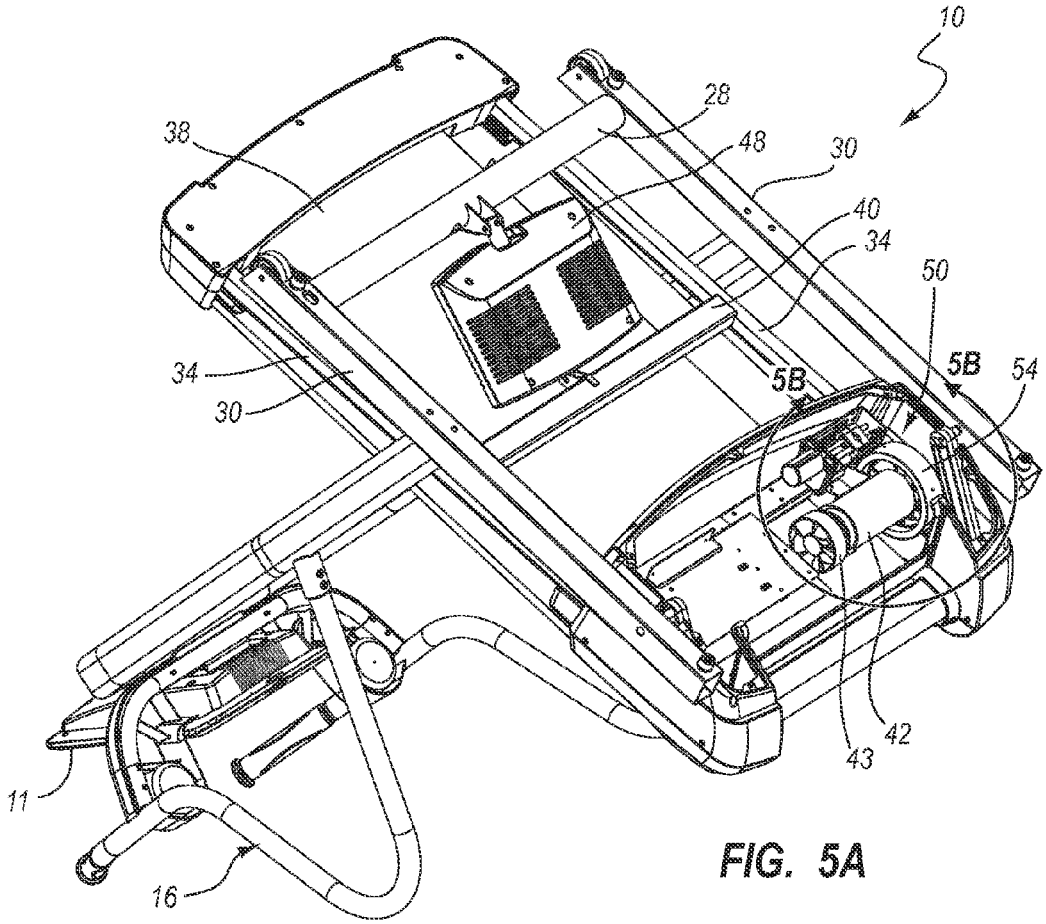
FIG. 5A is a bottom perspective view of the apparatus of FIG. 1 showing the position on the apparatus of the belt motor and braking system.
Figure 5B:
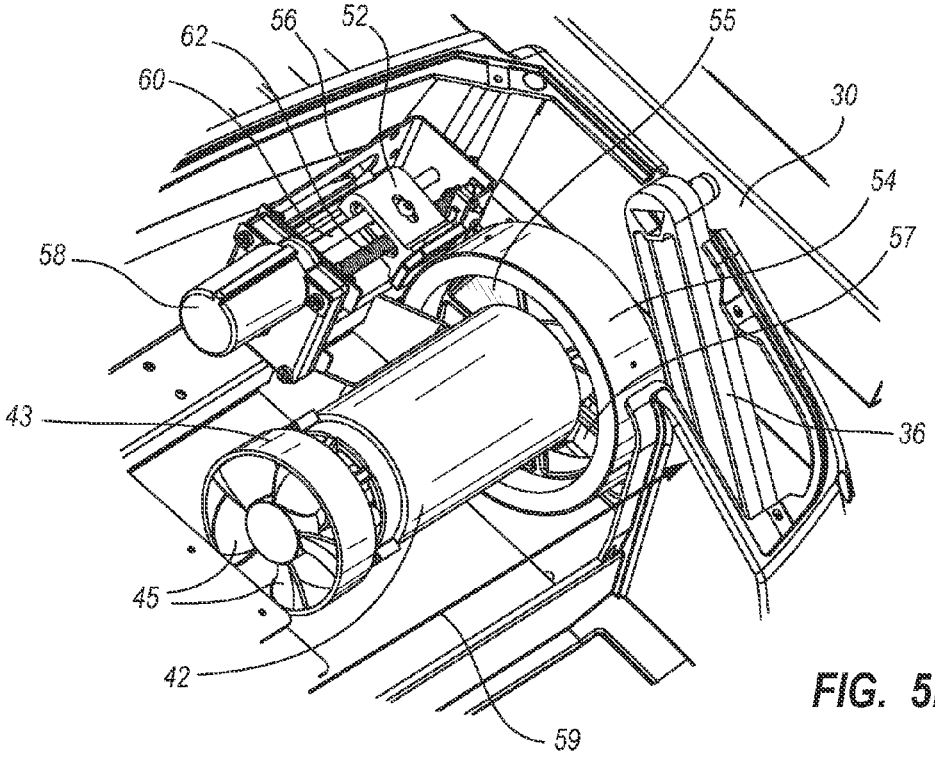
FIG. 5B is a cut-way view of the braking system shown in FIG. 5A.
Figure 6A:
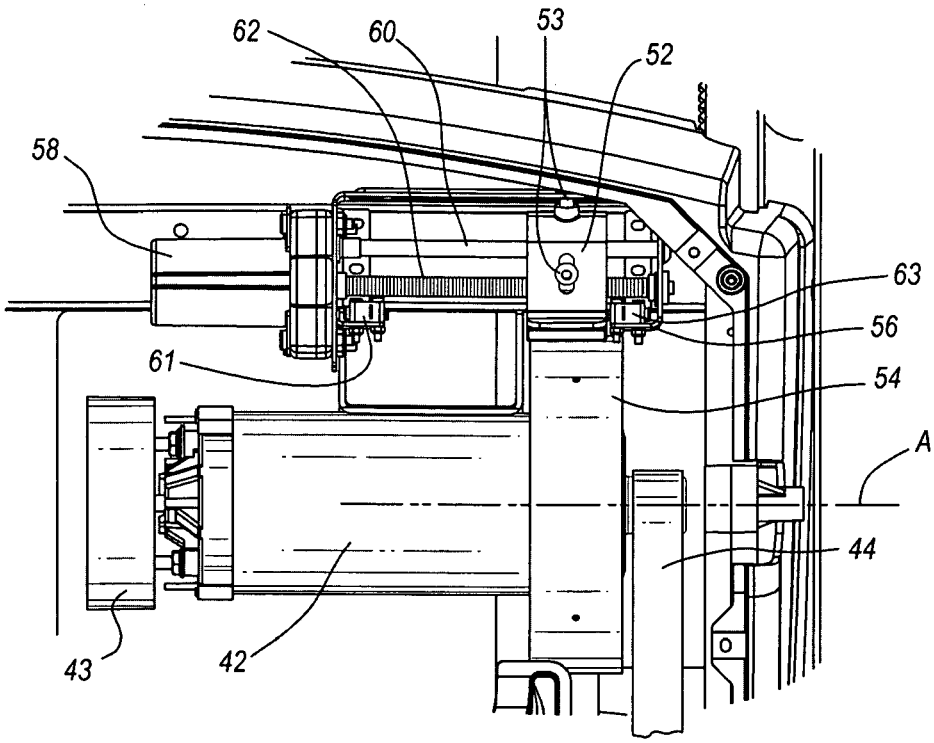
FIG. 6A is a cut-way bottom view of the braking system of FIG. 4 with the magnetic member positioned close to the flywheel.
Figure 6B:
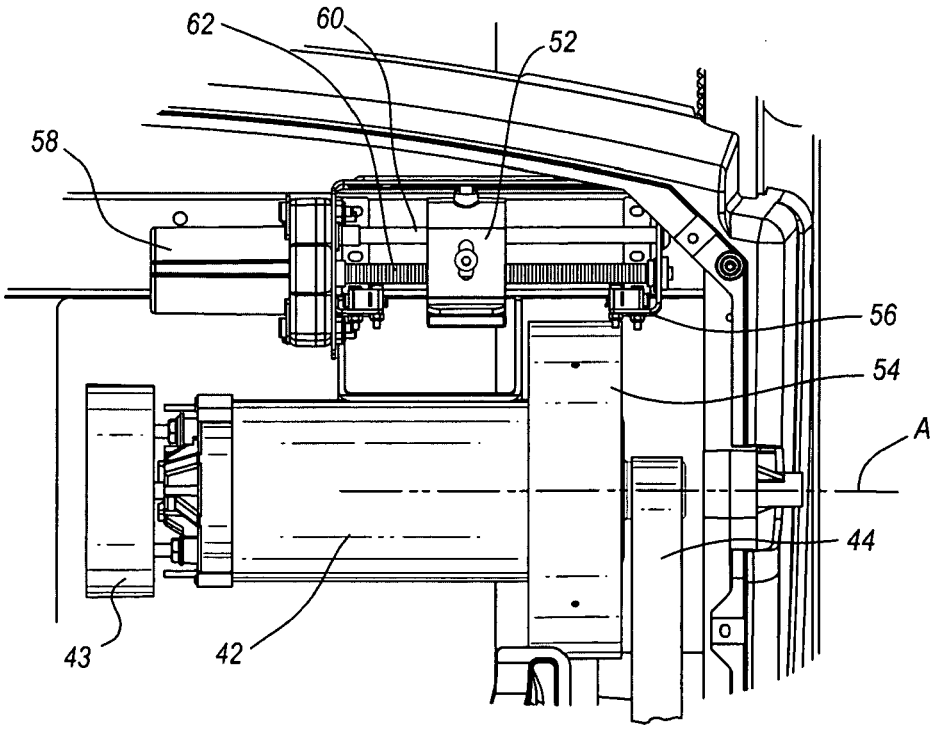
FIG. 6B is a cut-way bottom view of the braking system of FIG. 4 with the magnetic member positioned further away from the flywheel.

In one embodiment, fan 43 and flywheel 54 cooperate to cool motor 42 and/or braking system 50. For example, the blades 45 of fan 43 can be adapted to move air toward motor 42, while blades 55 of flywheel 54 are adapted to move air away from motor 42. The operation of motor 42 generates heat that is transferred to the air surrounding motor 42. Fan 43 is adapted to move cooler air toward motor 42, thereby moving the hot air away from motor 42. Blades 55 of flywheel 54 are adapted to draw away the air near motor 42. Therefore, fan 43 and blades 55 cooperate to move hot air away from motor 42, which provides a cooling affect to motor 42. Arrow 59 in FIG. 5B illustrates the direction of air flow when fan 43 and blades 55 cooperate in the manner described above. It will be appreciated, however, that fan 43 and/or blades 55 can be adapted to move air in other directions. For example, fans 43 can be adapted to move air away from motor 42, while blades 55 can be adapted to move air towards motor 42.

As mentioned above, treadbase 14 selectively moves between an inclined position (phantom lines in FIG. 2) in which distal end 24 is above a neutral position (solid lines in FIG. 2) and a declined position, in which distal end is below the neutral position. The selective movement of treadbase 14 between the declined, neutral, and inclined positions is facilitated by pivotally coupling proximal end 22 of treadbase 14 to proximal end 18 of support base 12. As will be appreciated by one of ordinary skill in the art, such pivotal coupling can be accomplished, for example, through the use of a bracket 36 that is pivotally connected at opposing ends to base 12 and treadbase 14 and through the use of inclination motor 48.

Hiking apparatus 10 is able to achieve an improved inclining/declining dynamic without requiring the use of a high stack of moving steps, paddles or foot supports. Instead, a vigorous hiking dynamic can be achieved in a significantly shorter room because clearance for steps, paddles, and supports is not necessary. The moving belt which acts as the ambulating surface for a user, can be adjacent the support surface even in the most intensely angled position.

By moving between the relatively extreme inclination ranges available with apparatus 10, an exerciser is able to simulate a hike or journey through a variety of different slopes and angles. The amount of inclination/declination can be controlled by an electronic control system 46 electrically coupled to inclination motor 48 discussed below. Electronic control system 46 can also controls belt speed and a variety of other features.

An example of one electronic control system 46 to be employed in the present invention is disclosed in U.S. Pat. No. 6,447,424, entitled "System and Method for Selective Adjustment of Exercise Apparatus", which is incorporated herein in its entirety by reference.

As mentioned above, the aspect ratio, i.e., the length and width of treadbase 14 is such that hiking apparatus 10 simulates a hiking motion, yet has a minimal footprint and can be conveniently used and stored in a home or exercise gym. In order to compensate for the intensity of the workout and to allow for lateral, i.e., side to side, movement common during hiking, in one embodiment, belt 38 is wider than typical treadmill belts. This dynamic provides an exerciser with lateral movement which is highly desirable during hiking, such as during inclining, declining and ambulating over rough terrain. Examples of some aspect ratios that can be used with apparatus 10 are disclosed in U.S. Pat. No. 6,761,667, entitled "Hiking Exercise Apparatus", which is incorporated herein by reference in its entirety.

The means for selectively moving treadbase 14 relative to support base 12 comprises inclination motor 48 or another linear extending assembly. Inclination motor 48 is pivotally coupled to support base 12 at one end thereof and pivotally coupled to treadbase 14 at an opposing end thereof. More particularly, in the illustrated embodiment motor 48 is pivotally coupled to cross member 28 of support base 12 and inner portion cross member 40 of treadbase 14. However, it is also possible to couple inclination motor 48 to a variety of different locations on treadbase 14 and support base 12.

In one embodiment, upon contraction of inclination motor 48, treadbase 14 moves to a declined position such that distal end 24 of treadbase 14 is positioned below the neutral position. When inclination motor 48 is selectively extended to an extended position, as shown in phantom lines in FIG. 2, treadbase 14 is inclined such that distal end 24 of treadbase 14 is positioned above the neutral position.

In one embodiment, inclination motor 48 is pivotally coupled to the inner portion of treadbase 14 (remotely from the ends) to facilitate the incline and decline of treadbase 14. This positioning of inclination motor 48 does not interfere with distal end 24 as it is lowered or raised. Thus, distal end 24 is able to be moved adjacent to the support surface without interference from a coupling mechanism. Furthermore, because an endless belt is the ambulating surface, rather than a series of steps, paddles or foot supports, there is no requirement for the additional clearance space otherwise required for steps, paddles or supports. This conserves space and enables a user to achieve a significantly inclined workout without requiring the exercise device to be overly tall.

As shown in FIGS. 4-6B, hiking apparatus 10 further comprises a braking system 50 which prevents belt 38 of treadbase 14 from being moved by a user faster than a certain desired speed. While braking system 50 is described herein as a magnetic braking system, it will be appreciated that braking system 50 can be an eddy braking system.

In the illustrated embodiment, braking system 50 is mounted to treadbase frame 32 adjacent motor 42. Braking system 50 comprises a magnetic member 52 that can be selectively moved relative to the flywheel 54 of motor 42. As magnetic member 52 moves closer to flywheel 54, the magnetic force experienced by flywheel 54 increases, which causes the rotational speed of flywheel 54 to decrease. The decreased rotational speed of flywheel 54 in turn decreases the speed of belt 38. Thus, when belt 38 begins to move at a faster than desired rate, magnetic member 52 is moved closer to flywheel 54 until belt 38 slows to the desired speed.

With attention to FIG. 5B-6B, braking system 50 will be described in greater detail. As can be seen, braking system includes a bracket 56 which is coupled to treadbase 14. Coupled to bracket 56 are the various components of braking system 50, such as a braking motor 58, a guide rod 60, and a lead screw 62. Guide rod 60 and lead screw 62 are mounted in bracket 56 such that they are positioned substantially parallel to one another. Furthermore, guide rod 60 and lead screw 62 are mounted such that they are substantially parallel to a longitudinal axis of belt motor 42 and a rotational axis of flywheel 54. This orientation and positioning of braking system 50, and in particular guide rod 60 and lead screw 62, relative to motor 42 allows for braking system 50 to occupy a minimal amount of space under treadbase 14, thereby enabling the overall size and height of apparatus 10 to be minimized. Braking system further includes sensors 61 and 63 which function as limit switches as described below.

Magnetic member 52 is moveably mounted within bracket 56 and on guide rod 60 and lead screw 62. As illustrated in the Figures, magnetic member 52 can be securely mounted to bracket 56 and lead screw 62 by way of bolts 53. Bolts 53 prevent magnetic member 52 from moving laterally relative to lead screw 62. Magnetic member 52 is slidably mounted on guide rod 60 and threadably mounted on lead screw 62. In this configuration, rotation by braking motor 58 of lead screw 62 about the longitudinal axis of lead screw 62 causes magnetic member 52 to move along the length of lead screw 62 while guide rod 60 prevents magnetic member 52 from rotating about lead screw 62. As can be seen in the Figures, magnetic member 52 moves along guide rod 60 and lead screw 62 is a direction that is generally parallel to a rotational axis A of flywheel 54. In this manner magnetic member 52 can move between a first position with respect to flywheel 54 and a second position that is closer to flywheel 54 than the first position.

Figure 7:
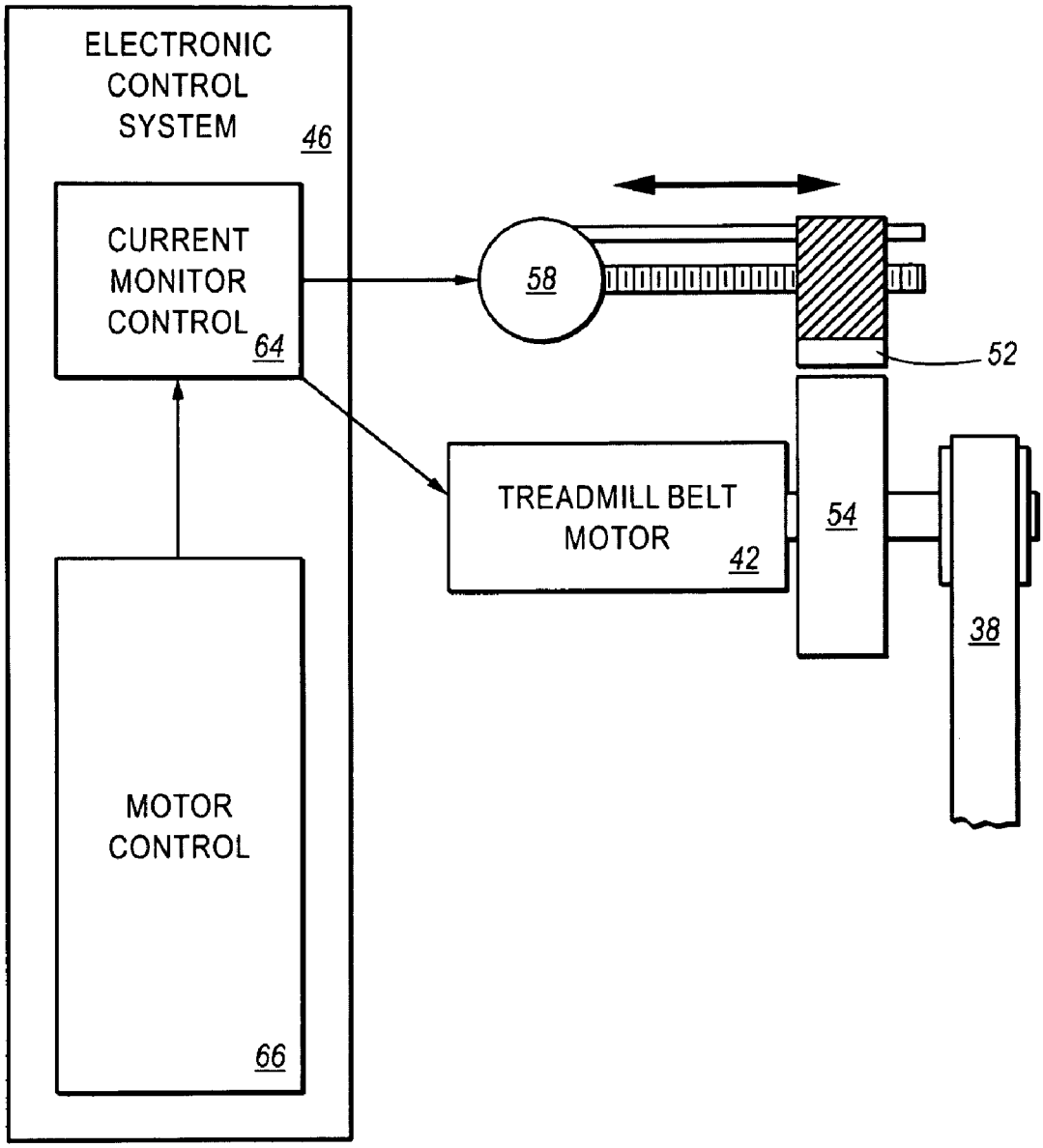
FIG. 7 is a block diagram illustrating how the braking system of FIGS. 4-6B is controlled.

With continuing reference to FIG. 4-6B, reference will now be made to FIG. 7 to describe how braking system 50 works in one embodiment. To use hiking apparatus 10, a user stands upon treadbase 14 and selects a desired incline and speed for treadbase 14 and belt 38. Selection of the desired incline and speed can be made at console 11 (FIGS. 1-3), which includes or is in communication with electronic control system 46. Once the desired incline and speed have been selected, electronic control system 46 adjusts the incline of treadbase 14 and begins to rotate belt 38. For example, electronic control system 46 can send a signal to inclination motor 48 to adjust the incline of treadbase 14. Similarly, electronic control system 46 can also send a signal to motor 42 to adjust the speed of belt 38.

As noted herein, the braking system 50 prevents belt 38 from exceeding a certain speed so that a user does not fall off of apparatus 10. The braking system 50 is useful at inclines such as in excess of about 11% grade and is particularly useful at high inclines, such as in excess of about 25% grade. As the degree of inclination of treadbase 14 increases, the likelihood that the user's weight will cause belt 38 to rotate at a rate which is faster than that desired (i.e., the speed selected by the user at console 11) also increases. To regulate the speed of belt 38, electronic control system 46 includes a current monitor and controller 64 in electrical communication with a motor controller 66 and braking motor 58. Motor controller 66 provides the current to operate motor 42, which drives belt 38. Braking motor 58 controls the movement of lead screw 62.

To regulate the speed of belt 38, current monitor and controller 64 monitors the amount of current being drawn from motor control 66 by motor 42. When belt 38 is rotating at the desired speed, the current being drawn from motor control 66 will remain at a generally constant level or within a predetermined range. When the current level remains generally constant or within the predetermined range, current monitor and controller 64 will take no action except to continue monitoring the current flowing to motor 42. To detect the current being drawn by motor 42, current monitor and controller 64 can include Hall Effect sensors, shunt resistors, and/or electromagnetic current sensors. It will be appreciated that other means for detecting current levels can also be used in current monitor and controller 64.

When a user begins to drive belt 38, either by pushing too hard on belt 38 and/or because the combination of the user's weight and the incline of treadbase 14 causes belt 38 to move faster than the desired speed, the current drawn by motor 42 drops. The drop in current is a result of motor 42 not having to work as hard to rotate belt 38 at the desired speed. Rather, the power to drive belt 38 is provided in part by the user and/or the inclination of treadbase 14.

When current monitor and controller 64 detects a drop in current drawn by motor 42, current monitor and controller 64 sends a signal to braking motor 58 to increase the amount of braking provided. In response to the signal from current monitor and controller 64, braking motor 58 rotates lead screw 62 in a first direction, which causes magnetic member 52 to move closer to flywheel 54, such as to the position shown in FIGS. 5B and 6A. Flywheel 54 preferably has a strip of copper thereon or another nonferrous metal. As magnetic member 52 moves closer to flywheel 54, the magnetic forces therebetween increase. The increased magnetic force causes the rotational speed of flywheel 54 to decrease. As appreciated by one of ordinary skill in the art, the rotational speed of flywheel 54 is directly related to the speed of belt 38. Thus, as the rotational speed of flywheel 54 decreases, the speed of belt 38 will also decrease.

Conversely, if current monitor and controller 64 detects an increase in current drawn by motor 42, current monitor and controller 64 can send a signal to braking motor 58 to reduce the amount of braking being provided. In response to the signal from current monitor and controller 64, braking motor 58 rotates lead screw 62 in a second direction, which causes magnetic member 52 to move further away from flywheel 54, such as to the position shown in FIG. 6B. As magnetic member 52 moves further away from flywheel 54, the magnetic forces therebetween decrease. The decreased magnetic force decreases the amount of braking, thereby allowing the rotational speed of flywheel 54, and thus belt 38, to increase.

In the manner described above, braking system 50 can regulate the speed of belt 38 to prevent belt 38 from rotating too fast and potentially causing a user to fall off of treadbase 14. In light of the disclosure herein, it will be appreciated that braking system 50 can also provide a continuously variable amount of braking. In particular, because magnetic member 52 can be incrementally moved along lead screw 62 toward and away from flywheel 54, the amount of braking provided by braking system 50 can be incrementally adjusted as well. Braking system 50 is one example of braking means for slowing the speed of the treadbase.

As noted above, braking system 50 can include sensors 61 and 63 which act as limit switches. More specifically, sensors 61 and 63 are adapted to detect when magnetic member 52 is positioned at an extreme end of lead screw 62. When magnetic member 52 is positioned at an extreme end of lead screw 62, sensor 61 or 63 will detect the position of magnetic member 52 and deactivate brake motor 58. Deactivation of brake motor 58 causes lead screw 62 to stop rotating, which in turn stops movement of magnetic member 52 along lead screw 62. Sensors 61 and 63 are thus adapted to prevent brake motor 58 from continuing to operate when magnetic member 52 is positioned at an extreme end of lead screw 62.

For example, in one embodiment a minimal amount of braking is desired when treadbase 14 is inclined at or below a grade of approximately 11% or 12%. To achieve the least amount of braking, magnetic member 52 is moved as far away from flywheel 54 as possible. It will be appreciated, however, that magnetic member 52 can only move to the extreme ends of lead screw 62. Thus, to prevent braking motor 58 from trying to move magnetic member 52 even further away from flywheel 54 by continuing to rotate lead screw 62, sensor 61 deactivates brake motor 58 when sensor 61 detects magnetic member 52 at the extreme end of lead screw 62. Sensor 63 functions in a similar manner when the maximum amount of braking is desired. In particular, magnetic member 52 provides the most braking when magnetic member 52 is positioned next to sensor 63. Once sensor 63 detects magnetic member 52 next to sensor 63, sensor 63 deactivates brake motor 58 to prevent brake motor 58 from trying to move magnetic member 52 even further along lead screw 62. It will be appreciated that in other embodiments the minimal amount of braking is desired at other grades based on the specifications of the device.

While braking system 50 has been described above with magnetic member 52 being movable relative to flywheel 54 in order to adjust the amount of braking provided to flywheel 54, it will be appreciated that other configurations of braking system are contemplated within the scope of the invention. In one embodiment, for example, magnetic member 52 is mounted within bracket 56 in a position similar to that shown in FIG. 6A. Rather than moving magnetic member 52 relative to flywheel 54 to adjust the amount of braking provided to flywheel 54, magnetic member 52 can be an electromagnet that can be turned on, off, or otherwise adjusted to change the amount of braking being provided. In such an embodiment, magnetic member 52 can remain stationary relative to flywheel 54, thereby decreasing the number of moving parts within braking system 50.

The manner in which the braking is adjusted when magnetic member 52 is an electromagnet is similar to that described above when magnetic member 52 moves relative to flywheel 54. In particular, current monitor and controller 64 monitors the amount of current being drawn by motor 42. When the current changes, current monitor and controller 64 adjusts the strength of electromagnetic member 52. As the magnetic field of electromagnet 52 changes, the rotational speed of flywheel 54 changes as described above. Specifically, when the current used by motor 42 drops, the strength of the magnetic field produced by magnetic member 52 is increased, thereby increasing the amount of braking provided. Conversely, when the current used by motor 42 increases, the strength of the magnetic field produced by magnetic member 52 is reduced, thereby reducing the amount of braking provided. Additionally, the amount of braking provided can be continuously variable or incrementally adjusted by adjusting the magnetic field strength produced by the magnetic member 52.

With reference now to FIGS. 8-11, an alternate hiking exercise apparatus 141 is shown. Apparatus 141 comprises a support base 142, a treadbase 144 movably coupled at a proximal end thereof to support base 142 and handrail assembly 146 coupled to support base 142.

Figure 8:
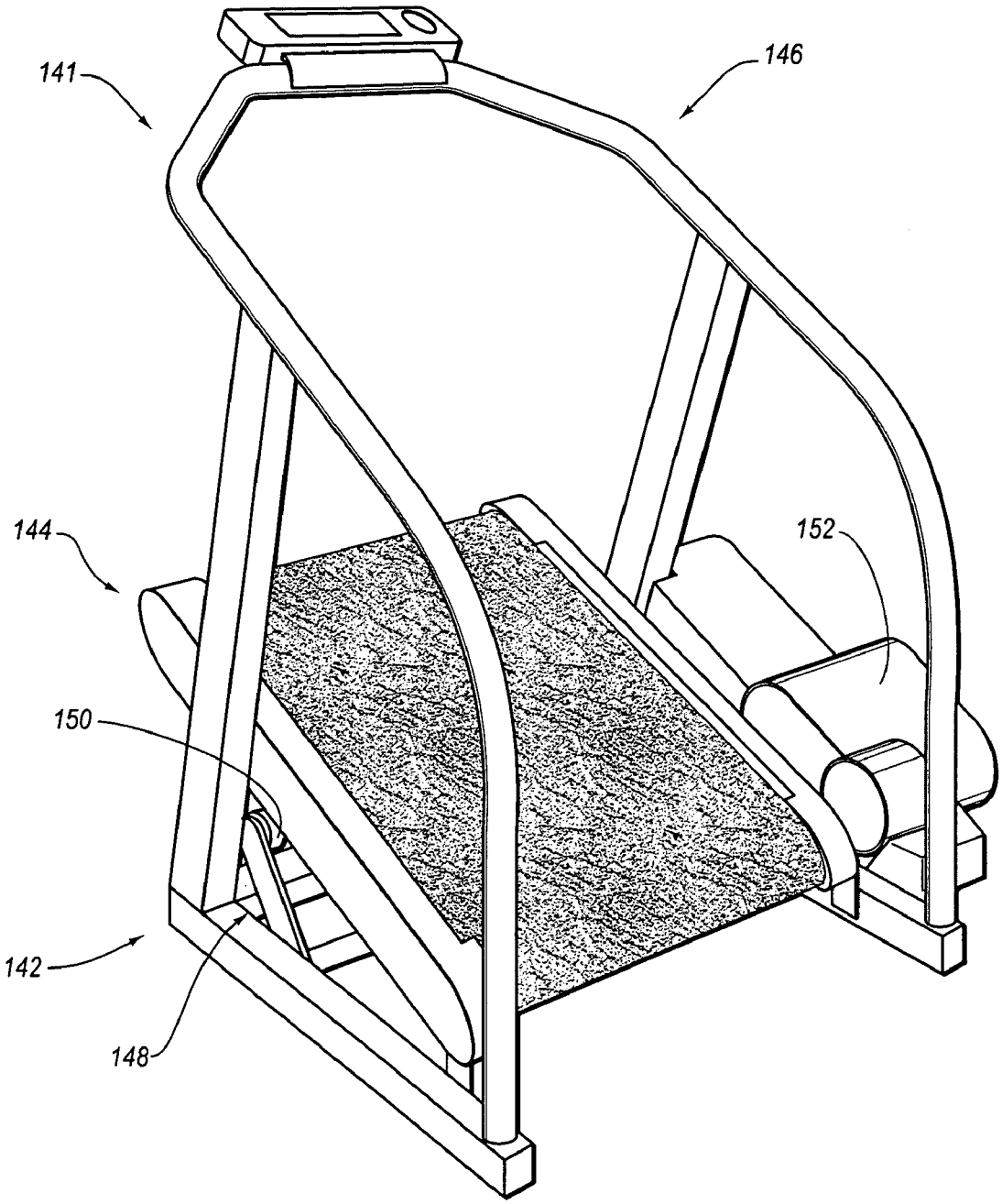
FIG. 8 illustrates a perspective view of an alternate hiking exercise apparatus according to the present invention.
Figure 9:
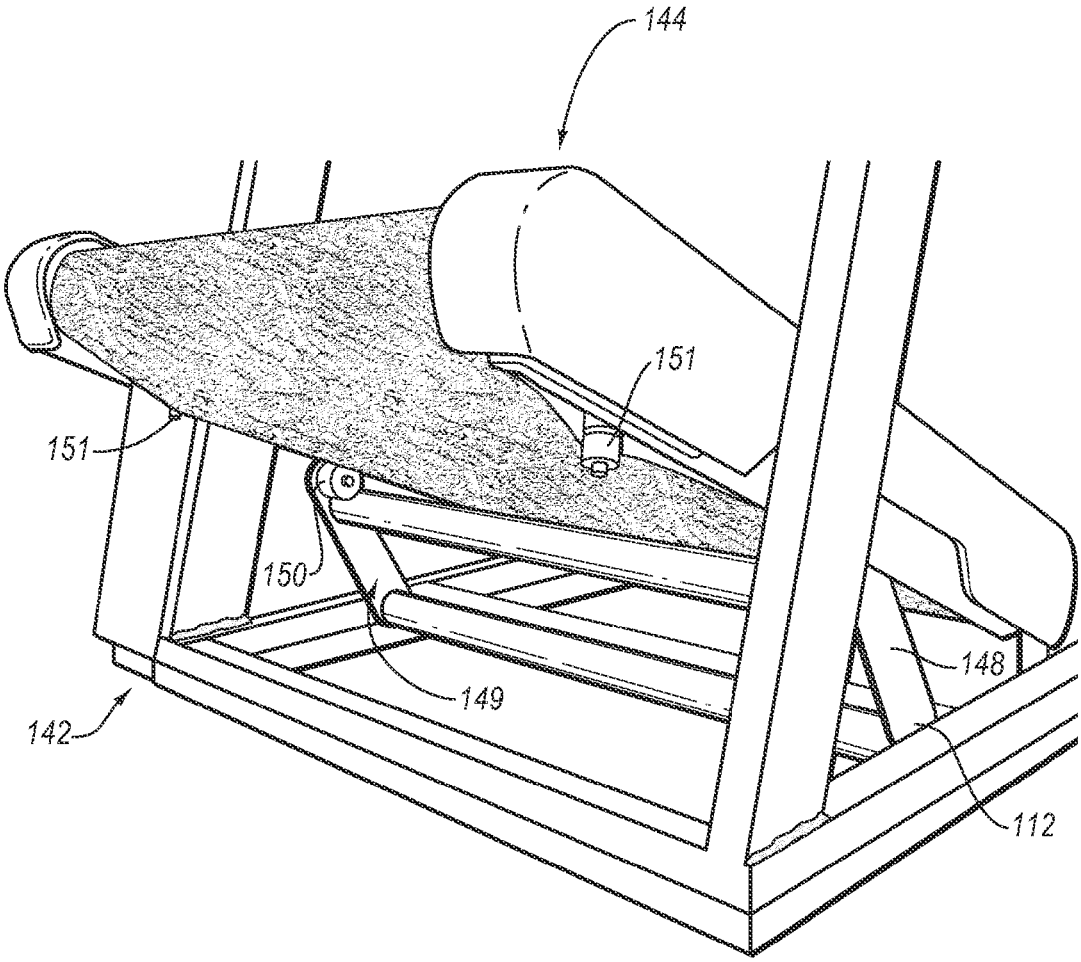
FIG. 9 is a front cut-away view of the exercise apparatus of FIG. 8.

The means for selectively moving treadbase 144 shown in FIGS. 8-11 comprises (i) a linear extending assembly in the form of an extension motor 164 (FIGS. 10-11); and (ii) a pivoting lever 148. Motor 164 is pivotally coupled to base 142 at one end thereof and pivotally coupled to pivoting lever 148 at an opposing end. Pivoting lever 148 is pivotally coupled at a lower end thereof 112 to support base and has at an upper end thereof a rotating wheel 150 (FIGS. 8-9). Wheel 150 rolls against treadbase 104. Rolling belt guides 151 on opposing sides of the endless belt maintain the belt in a desired, aligned position on the treadbase rollers Each guide 151 comprises a wheel rolling on an axle. These guides 151 are useful at extreme inclines and prevent the belt from sliding from one side to another.

Figure 10:
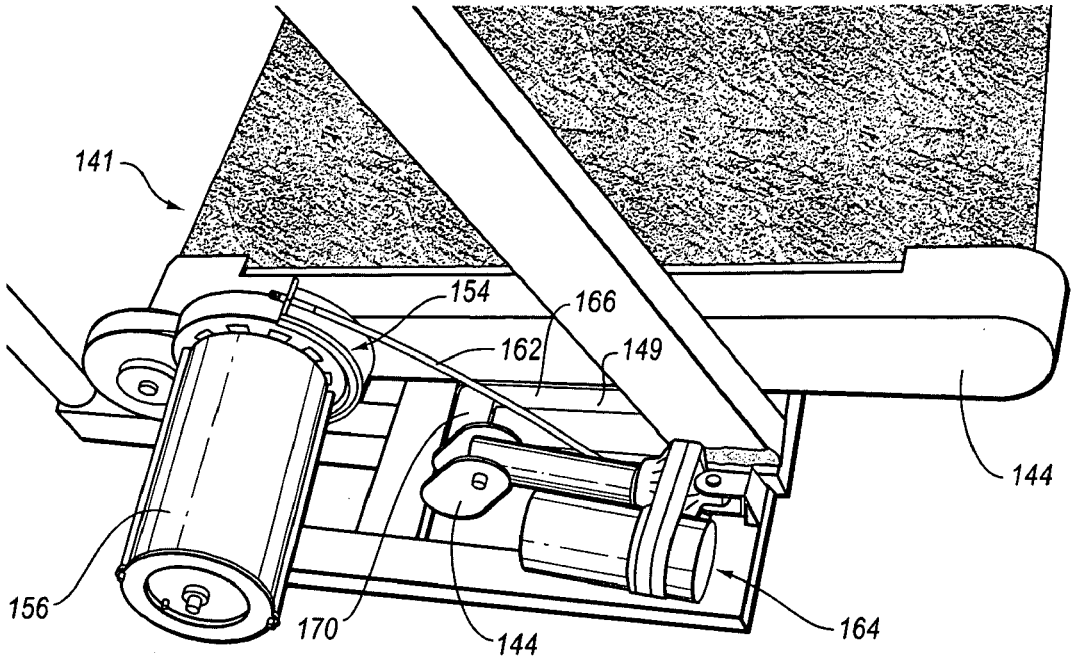
FIG. 10 is a side cut-away view of the exercise apparatus of FIG. 8 with the treadbase shown in a neutral position.
Figure 11:
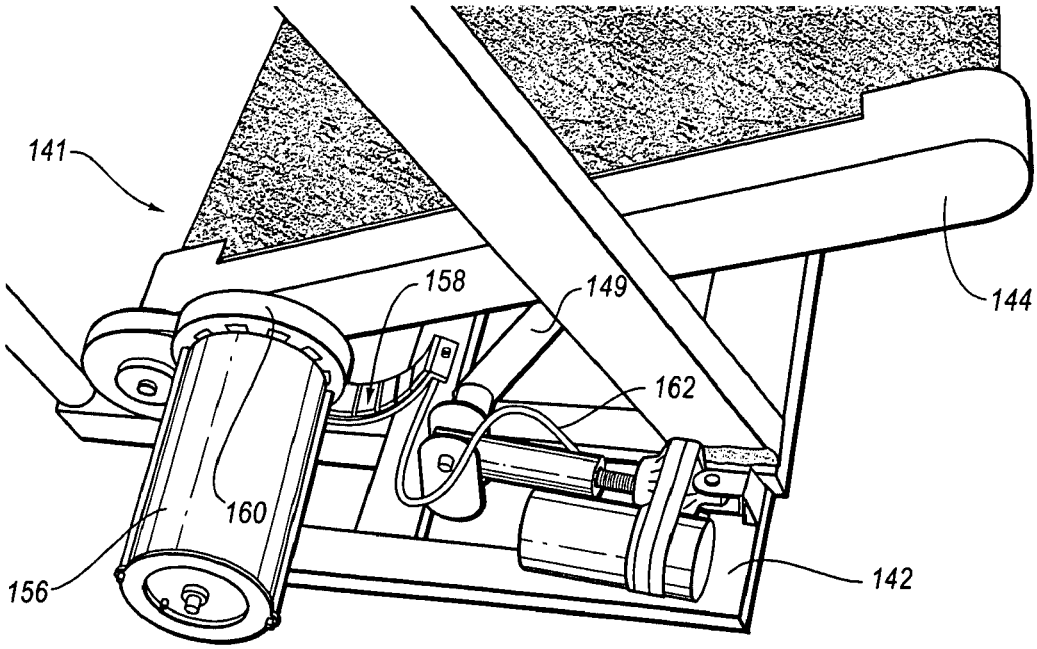
FIG. 11 is another side cut-away view of the exercise apparatus of FIG. 8 with the treadbase shown in an inclined position.

Upon selective contraction of linear extending assembly 164 as shown in FIG. 10, lever 148 is moved downwardly. When extension motor 164 is selectively extended to an extended mode, as shown in FIG. 11, lever 148 is in an upward position such that the position of treadbase 144 is inclined. In one embodiment, as shown in FIG. 9, first and second levers 148, 149 having wheels thereon are coupled to opposing sides of support base 142 such that each end of treadbase 144 receives a rolling lever thereon. However, a single lever 148 may also be employed. Also as shown in FIGS. 10 and 11 (which is shown in a cut-away view from a side thereof with a cosmetic hood 152 shown in FIGS. 8-9 removed), beam 166 of lever 149 is coupled to a lever bracket 168 by a cross member which extends through a sleeve 170 coupled to support base 142. Extension motor 164 is pivotally coupled to bracket 168.

Also as shown in the embodiments of FIGS. 10 and 11, hiking apparatus 141, further comprises a braking system 154 which prevents the belt of treadbase 144 from being moved by a user faster than a certain desired speed. Braking system 154 comprises an eddy magnet comprising a magnetic member 158 coupled adjacent the flywheel 160 of motor 156. Magnetic member 158 is secured in a desired position by a cord 162 coupled to base 142.

Braking system 154 is adapted to regulate or control the rotational speed of flywheel 160 and the belt of treadbase 144. More specifically, magnetic member 158 is adapted to move between a first position close to flywheel 160, as shown in FIG. 10, and a second position further away from flywheel 160, as shown in FIG. 11. Braking system 154 provides a greater amount of braking force when magnetic member 158 is in the first position as compared to the amount of braking provided when magnetic member 158 is in the second position. In particular, the magnetic force experienced by flywheel 160 when magnetic member 154 is close to flywheel 160 is larger than the magnetic force experienced by flywheel 160 when magnetic member 154 is further away from flywheel 160. The rotational speed of flywheel 160 decreases as the magnetic force increases. Thus, the rotational speed of flywheel 160 can be selectively adjusted by adjusting the position of magnetic member 154 relative to flywheel 160.

A variety of other braking means for slowing the speed of the treadbase are also available for use on the apparatuses disclosed herein, such as a friction brake, a gear brake, a disk brake, a band, a motor which drives in an opposite direction, a portion of a motor which is an integral braking system, a motor geared not to exceed a certain speed, and a variety of other such assemblies, and a variety of other braking systems such as the braking systems disclosed in U.S. patent application Ser. No. 09/496,560, entitled "System and Method for Selective Adjustment of Exercise Apparatus," filed on Feb. 2, 2000, now U.S. Pat. No. 6,447,424, which is incorporated herein by reference in its entirety.

A handrail assembly, such as handrail assembly 16 or 146, of the present invention may be a single handrail (i.e., held by one hand only), first and second handrails coupled to each other, a single handrail with a motor attached thereto, first and second handrails each with a motor coupled thereto, a two-part assembly, a telescoping assembly, a solid handrail, a tubular handrail, or a variety of other handrails, each of which are also examples of means for supporting at least one arm of a user ambulating on the treadbase. Examples of various types of handrail assemblies are disclosed in U.S. Pat. No. 6,761,667, entitled "Hiking Exercise Apparatus", which is incorporated herein by reference in its entirety. The frames of the apparatuses herein may include wheels thereon for moving the apparatuses, such as on the support bases.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A selectively inclining treadmill apparatus which supports a user ambulating thereon, the selectively inclining treadmill apparatus comprising:

a treadbase adapted to selectively incline, the treadbase comprising:

a treadbase frame;

an endless belt mounted on the treadbase frame, wherein the endless belt is configured such that a user may ambulate thereon;

a flywheel linked to the treadbase frame; and a braking system adapted to regulate the speed of the endless belt, the braking system comprising a magnetic member adapted to move between a first position with respect to the flywheel and a second position that is closer to the flywheel than the first position, wherein the magnetic member is positioned adjacent to the outer circumference of the flywheel, and wherein the magnetic member moves parallel to the axis of rotation of the flywheel between the first position and the second position.

2. A selectively inclining treadmill apparatus as recited in claim 1, further comprising a braking motor that is responsive to control circuitry signals to cause the movement of the magnetic member.

3. A selectively inclining treadmill apparatus as recited in claim 1, further comprising a guide rod upon which the magnetic member is slidably mounted.

4. A selectively inclining treadmill apparatus as recited in claim 1, wherein the magnetic member moves between the first position and the second position on a lead screw.

5. A selectively inclining treadmill apparatus as recited in claim 1, further comprising:

a support base, wherein the treadbase is adapted to selectively incline with respect to the support base; and a belt motor coupled to the treadbase frame, wherein the belt motor is configured to drive the endless belt.

6. A selectively inclining treadmill apparatus as recited in claim 5, further comprising control circuitry adapted to monitor the amount of current used by the belt motor to drive the endless belt.

7. A selectively inclining treadmill apparatus as recited in claim 6, wherein the control circuitry is adapted to move the magnetic member between the first position and the second position when the current used by the belt motor decreases.

8. A selectively inclining treadmill apparatus as recited in claim 1, further comprising a braking motor that is adapted to move the magnetic member between the first position and the second position in response to a control signal generated upon the occurrence of a predetermined condition.

9. A selectively inclining treadmill apparatus which supports a user ambulating thereon, the selectively inclining treadmill apparatus comprising:

a treadbase adapted to selectively incline, the treadbase comprising:

a treadbase frame having a flywheel linked thereto;

an endless belt mounted on the treadbase, wherein the endless belt is configured such that a user may ambulate thereon; and a braking system adapted to regulate the speed of the endless belt, the braking system comprising a magnetic member mounted on a lead screw, the magnetic member being adapted to move between a first position with respect to the flywheel and a second position that is closer to the flywheel than the first position when the lead screw is rotated about a longitudinal axis.

10. A selectively inclining treadmill apparatus as recited in claim 9, wherein movement of the magnetic member between the first and second positions is along an axis generally parallel to a rotational axis of the flywheel.

11. A selectively inclining treadmill apparatus as recited in claim 9, wherein the braking system further comprises a guide rod.

12. A selectively inclining treadmill apparatus as recited in claim 11, wherein the magnetic member is slidably mounted on the guide rod.

13. A selectively inclining treadmill apparatus as recited in claim 12, wherein the guide rod prevents the magnetic member from rotating about the lead screw.

14. A selectively inclining treadmill apparatus as recited in claim 9, wherein the flywheel comprises a metallic material on a rim thereof, and the flywheel dissipates heat away from the periphery of the flywheel.

15. A selectively inclining treadmill apparatus which supports a user ambulating thereon, the selectively inclining treadmill apparatus comprising:

a treadbase adapted to selectively incline, the treadbase comprising:

a treadbase frame having a flywheel coupled thereto;

an endless belt mounted on the treadbase frame, wherein the endless belt is configured such that a user may ambulate thereon; and a braking system adapted to regulate the speed of the endless belt, the braking system comprising a magnetic member mounted on a lead screw and a guide rod, the magnetic member being adapted to move between a first position with respect to the flywheel and a second position that is closer to the flywheel than the first position, and wherein movement between the first position and the second position is along a length of the lead screw.

16. A selectively inclining treadmill apparatus as recited in claim 15, wherein the magnetic member is threadably mounted on the lead screw.

17. A selectively inclining treadmill apparatus as recited in claim 15, wherein the braking mechanism further comprises a braking motor for rotating the lead screw.

18. A selectively inclining treadmill apparatus as recited in claim 17, wherein the braking motor is receptive to electronic signals from control circuitry of the treadmill apparatus.

19. A selectively inclining treadmill apparatus as recited in claim 18, wherein control circuitry sends an electronic signal to the braking motor when the endless belt begins to rotate faster than a predetermined speed.

20. A selectively inclining treadmill apparatus as recited in claim 18, wherein the electronic signal causes the braking motor to rotate the lead screw, thereby causing the magnetic member to move between the first position and the second position.

21. A selectively inclining treadmill apparatus which supports a user ambulating thereon, the selectively inclining treadmill apparatus comprising:

a treadbase adapted to selectively incline, the treadbase comprising:

a treadbase frame;

an endless belt mounted on the treadbase frame, wherein the endless belt is configured such that a user may ambulate thereon;

a flywheel linked to the treadbase frame; and a braking system adapted to regulate the speed of the endless belt, the braking system comprising a magnetic member adapted to move between a first position with respect to the flywheel and a second position that is closer to the flywheel than the first position, wherein the magnetic member moves between the first position and the second position on a lead screw.

22. A selectively inclining treadmill apparatus as recited in claim 21, wherein movement of the magnetic member between the first and second positions is along an axis generally parallel to a rotational axis of the flywheel.

23. A selectively inclining treadmill apparatus as recited in claim 21, further comprising a guide rod upon which the magnetic member is slidably mounted.

24. A selectively inclining treadmill apparatus as recited in claim 21, wherein the braking system further comprises a braking motor for rotating the lead screw.

25. A selectively inclining treadmill apparatus as recited in claim 24, wherein the braking motor is receptive to electronic signals from control circuitry of the treadmill apparatus.

26. A selectively inclining treadmill apparatus as recited in claim 25, wherein control circuitry sends an electronic signal to the braking motor when the endless belt begins to rotate faster than a predetermined speed.

27. A selectively inclining treadmill apparatus as recited in claim 26, wherein the electronic signal causes the braking motor to rotate the lead screw, thereby causing the magnetic member to move between the first position and the second position.

28. A selectively inclining treadmill apparatus which supports a user ambulating thereon, the selectively inclining treadmill apparatus comprising:

a treadbase adapted to selectively incline, the treadbase comprising:

a treadbase frame;

an endless belt mounted on the treadbase frame, wherein the endless belt is configured such that a user may ambulate thereon;

a belt motor coupled to the treadbase frame and configured to drive the endless belt;

a flywheel coupled to the belt motor;

a braking system adapted to regulate the speed of the endless belt, the braking system comprising a magnetic member adapted to move between a first position with respect to the flywheel and a second position that is closer to the flywheel than the first position; and control circuitry adapted to monitor the amount of current used by the belt motor to drive the endless belt, wherein the control circuitry is adapted to move the magnetic member between the first position and the second position when the current used by the belt motor decreases.

29. A selectively inclining treadmill apparatus as recited in claim 9, further comprising a belt motor coupled to the treadbase frame and configured to drive the endless belt.

30. A selectively inclining treadmill apparatus as recited in claim 2, further comprising a support base, wherein the treadbase is adapted to selectively incline with respect to the support base.

31. A selectively inclining treadmill apparatus as recited in claim 15, further comprising a belt motor coupled to the treadbase frame and configured to drive the endless belt, the belt motor having a longitudinal axis.

32. A selectively inclining treadmill apparatus as recited in claim 31, wherein the lead screw and the guide rod are substantially parallel to the longitudinal axis of the belt motor.

33. A selectively inclining treadmill apparatus as recited in claim 21, further comprising:

a support base, wherein the treadbase is adapted to selectively incline with respect to the support base; and a belt motor coupled to the treadbase frame, wherein the belt motor is configured to drive the endless belt.

* * * * *

UNITED STATES PATENT AND TRADEMARK OFFICE

CERTIFICATE OF CORRECTION

PATENT NO. : 7,862,483 B2
APPLICATION NO. : 12/340407
DATED : January 4, 2011
INVENTOR(S) : Hendrickson et al.

It is certified that error appears in the above-identified patent and that said Letters Patent is hereby corrected as shown below:

Title Page, Right Column

Change the Primary Examiner from "Loan Thanh" to --LoAn Thanh--

Drawings

Sheet 10, replace Figure 10 with the figure depicted below, wherein one instance of "144" has been changed to --168--

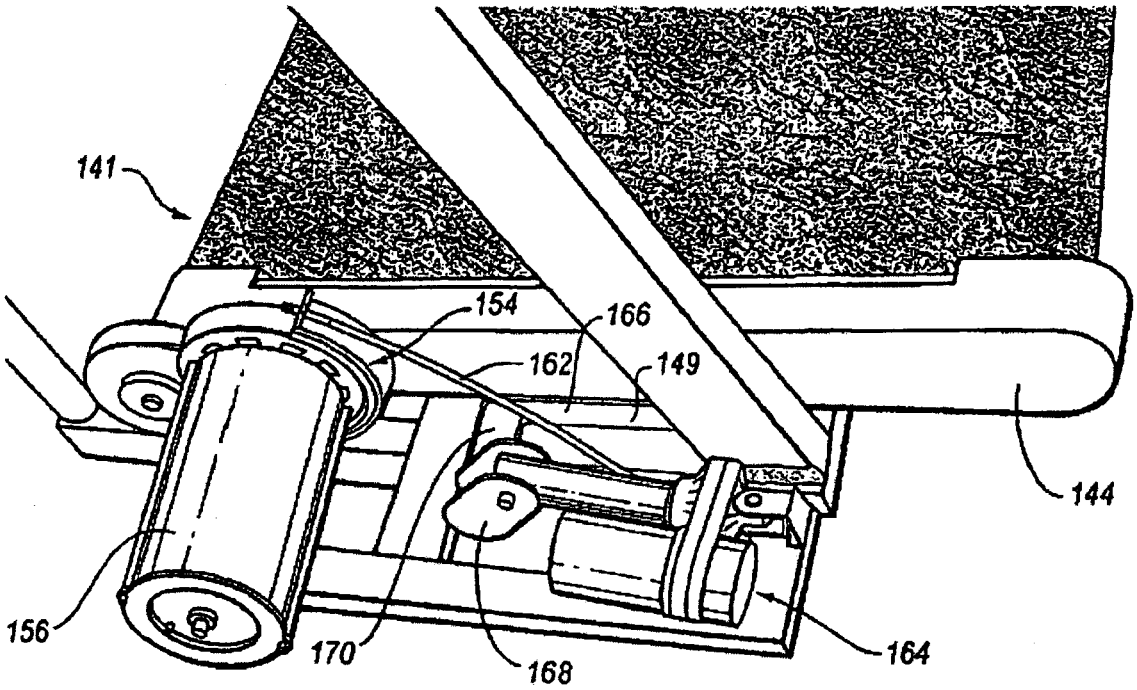

FIG. 10

Column 3

Signed and Sealed this
Seventeenth Day of May, 2011

David J. Kappos

David J. Kappos
*Director of the United States Patent and Trademark Office*

Line 48, change “cut-way” to --cut-away--
Line 50, change “cut-way” to --cut-away--
Line 53, change “cut-way” to --cut-away--

Column 5
Line 35, before “conducted” insert --be--

Column 6
Line 13, change “controls” to --control--

Column 7
Line 14, change “FIG.” to --FIGS.--
Line 49, change “FIG.” to --FIGS.--

Column 10
Line 15, change “lower end thereof 112” to --lower end 112 thereof--
Line 17, change “treadbase 104” to --treadbase 144--
Line 19, change “rollers Each” to --rollers. Each--
Line 57, change “magnetic member 154” to --magnetic member 158--
Line 59, change “magnetic member 154” to --magnetic member 158--